United States Patent [19]

Shamp

[11] 4,410,175

[45] Oct. 18, 1983

[54] SAFETY SUSPENSION UNIT AND HARNESS FOR DEVELOPING JUMPS IN FIGURE SKATING

[76] Inventor: Ellis W. Shamp, 1623 Butte, Richmond, Calif. 94804

[21] Appl. No.: 284,334

[22] Filed: Jul. 17, 1981

[51] Int. Cl.[3] ..... A63B 7/00

[52] U.S. Cl. ..... 272/70; 114/215; 182/3; 182/6; 244/151 R; 272/24; 272/109

[58] Field of Search ..... 272/70, 109, 61, 24; 128/133, 134, 135; 182/3, 4, 5, 6, 231, 232; 254/277, 380; 267/128; 114/213, 215, 216, 217; 244/151 R, 151 A, 151 B; 119/96; D30/20

[56] References Cited

U.S. PATENT DOCUMENTS

| | | | |
|---|---|---|---|
| 213,629 | 3/1879 | Cottingham | 114/213 |
| 546,788 | 9/1895 | Sheldon | 114/215 |
| 895,055 | 8/1908 | Spooner | 272/70 |
| 1,385,773 | 7/1921 | Boland | 244/151 R |
| 2,245,293 | 6/1941 | Ogburn | 128/134 |
| 2,772,085 | 11/1956 | Dodge | 267/128 |
| 3,476,385 | 11/1969 | Foy | 272/24 |
| 3,721,436 | 12/1970 | Barthel | 272/70 |
| 4,204,719 | 5/1980 | Murphy | 272/70 X |
| 4,256,098 | 3/1981 | Swan et al. | 272/70 X |

FOREIGN PATENT DOCUMENTS

| | | | |
|---|---|---|---|
| 43032 | 9/1930 | Denmark | 272/109 |
| 371764 | 1/1907 | France | 114/215 |
| 619515 | 4/1961 | Italy | 182/3 |
| 227574 | 1/1925 | United Kingdom | 182/6 |
| 484390 | 5/1938 | United Kingdom | 182/3 |

*Primary Examiner*—Richard C. Pinkham
*Assistant Examiner*—Arnold W. Kramer

[57] ABSTRACT

A safety suspension unit with a tracking carriage connectable to an elevated fixed track, the suspension unit having a spring loaded pulley system with a support cable connected to a harness for aiding a skater, in the learning and practicing of jumps and spins. The tension in the spring which loads the pulley system is increased as the support cable is dispensed.

7 Claims, 4 Drawing Figures

SAFETY SUSPENSION UNIT AND HARNESS FOR DEVELOPING JUMPS IN FIGURE SKATING

BACKGROUND OF THE INVENTION

This invention relates to sports equipment, particularily sports safety equipment used in the learning and practice phase of the development of a performance proficiency. The safety suspension unit and harness is designed specifically for the sport of competitive ice skating, but is useable for other related sports such as roller skating or gymnastics, where difficult aerial body movements are attempted with a degree of physical danger to the athlete during the learning and practicing of an acrobatic movement.

The safety suspension unit is designed to provide a safety support to an individual wearing a support harness, preferable of the type herein described, that is connected to a cable in the suspension unit, while allowing the individual a degree of movement in the horizontal and vertical directions as well as controlled rotation. This restricted freedom permits an individual to practice a jump and spin, which is key to successful competitive free skating. The function of the suspension unit is primarily to provide a reduction in the weight of the athlete with a limit in overall displacement of the athlete, for example to arrest a fall.

The process in arresting the fall is accomplished by means of an increasing, resisting force that avoids an abrupt and potentially hazardous yanking action. This means is preferably done by a spring action which is selectably replaceable according to the weight of the user. However, more sophisticated pneumatic or hydraulic means can be employed to the same effect. Similarly, a spring loaded reel can provide for the desired action, with, however, a somewhat greater change for malfunction by cable binding.

While rotation for a skater is primarily about a vertical axis, for which the disclosed harness is particularly devised, other athletes may seek rotation about a horizontal axis requiring a trapeze like bar pivotally attached to the front or back of a conventional safety belt. This would permit practice of acrobatic movements such as flips on a balance beam.

Prior to the development of the device disclosed herein, such safety suspension was accomplished simply by a ceiling mounted pulley and tracking cable connected at one end to a waist harness on the athlete and held at the other end by an instructor or attendant.

The safety suspension unit and harness is devised to be used without the manual assistance and direct attention of an attendant. However, as in the practice and development of all difficult acrobatic movements, it is recommended that this equipment should not be used alone.

SUMMARY OF THE INVENTION

The safety suspension unit and accompanying harness comprises a suspension device for supporting an athlete on a cable. The suspension unit includes a tracking carriage that travels on a fixed elevated track. The track is usually mounted to the ceiling, but may be supported between two vertical members above the area in which the acrobatic movement is to occur. The tracking carriage is designed to allow free movement along the length of the track, although provision may be included for fixing the carriage at a select position on the track.

The tracking carriage includes a suspension cable which is connected to a spring and pulley system that suspends a free end of the cable for connection to a harness or other support mechanisms for the user. The spring and pulley system provides a cushioned anchoring of the suspension cable to the carriage. The preferred pulley arrangement allows a 3–1 cable travel relative to the carriage and a 3–1 reduction in the effect of the spring force.

The preferred harness for the application of the safety suspension unit for ice skaters utilizes a soft strap system to direct supporting forces to the upper portion of the legs of a user with a body fulcrum point at the upper waist or lower back of the user whereby in full suspension of the user, the body of the user is oriented in an upright position with a slight forward cant. This orientation is achieved by a waist belt to which an upwardly directed support loop is connected at ring connections at the back of the belt. Below the support loop are buckled two depending straps with belt loops that are fastened around each upper leg by buckles located at each side of the user's hips.

The support loop is connected to a swivel connector at the end of the cable. The user can thus perform, with or without skates a horizontal movement with a jump and spin with varying degree of vertical support and the safety of restricted fall.

The preferred mechanism for accomplishing this action is described in greater detail in the detailed description of the preferred embodiment hereafter.

DETAILED DESCRIPTION OF THE PREFERRED EMBODIMENT

Figures 1, 2:
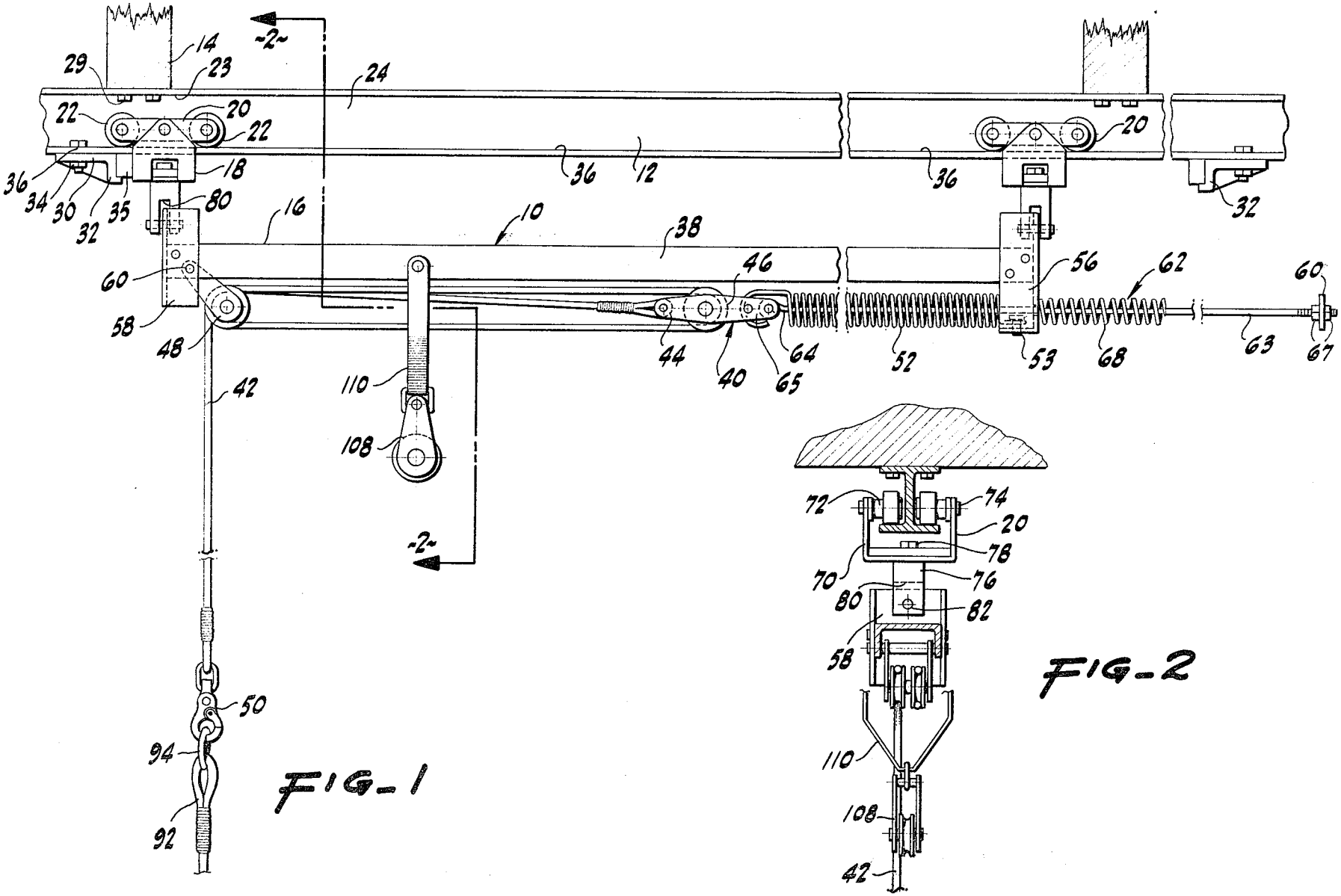
FIG. 1 is a side elevational view of the safety suspension unit.
FIG. 2 is a cross-sectional view taken on the lines 2—2 in FIG. 1.

Referring to FIG. 1, the safety suspension unit, designated generally by the reference 10 is shown.

The safety unit includes a fixed track 12 which is fabricated from an elongated I-beam fastened to a structural support such as a pair of spaced ceiling beams 14, and a movable carriage 16 which has a tracking mechanism 18 connecting the carriage 16 to the track 12. The tracking mechanism 18 is formed by two roller units 20 at each end of the carriage with pairs of tandem roller wheels 22 straddling each side of the web portion 24 and riding on the lower plate portion 26 of the I-beam track 12. The upper plate portion 28 provides a convenient attachment mount for bolts 29 which fasten the track 12 to the ceiling beams 14. The track 12 is equipped with stops 30 which comprise a block 32 with a rubber face 35 connected to the track by the bolts 34 which pass through holes 36 in the lower plate portion 26 of the track. The holes are strategically spaced along the track to vary the tracking length and in fact fix the carriage at select locations by bracketing the carriage with stops.

The carriage 16 has an elongated U-channel body 38 which partially contains a spring and pulley system 40 for dispensing a cable 42. The cable 42 is preferable fabricated from a woven nylon rope which is attached at one end to the becket 44 of a first pulley 46. The cable threads around a spacially displaced, second, double wheel pulley 48, around the first pulley 46 and back over the second pulley to terminate with a free end having a swivel clip 50. The swivel clip 50 is preferably of a ball bearing type to allow for relatively free rotation under load.

The first pulley 46 is connected to the free end of a tension spring 52 nestled in the U-channel body 38 and anchored to a pin 53 in the end bracket 56 of the carriage. The second pulley 48 is anchored to the opposite end bracket 58 by a cross bolt assembly 60. To limit the expansion of the spring 52 and the travel of the first pulley, the carriage body has a stop mechanism 62 with an elongated rod 63 slidably connected to the end bracked 56 of the carriage body. The rod 63 is connected at one end by a hook loop 64 to the halter of the displaceable first pulley 46. The opposite end which protrudes through end bracket 56 has a stop washer 66 secured by bolts 67. Carried on the protruding portion is a stiff compression spring 68. When the pulley 46 is displaced and tension spring 52 elongated, the rod 63 pulls the stop washer 66 to the compression spring 68. As is expected the restraining force exerted by the tension spring increases as the cable is extracted from the carriage, providing a linearly increasing force before contact of the compression spring which provides a cushioned stop on full compression.

With reference to FIG. 2, the roller units 20 have a central yoke-like bracket 70 with a pair of spaced mounting arms 72 having a pivotal connection pin 74 providing for limited pivot relative to the mounting arms to insure even contact of the roller wheels 22 at each end of the mounting arms. The yoke-like bracket 70 is fixedly connected to a block 76 by a bolt 78. The block 76 in turn has a slot 80 which engages the respective end bracket 56 and 58 by a pin 82 to allow a limited pivot or cant to the body 38 of the carriage 16 when the pull on the cable 42 is not exactly aligned to the carriage during use, to prevent side stresses on the double wheel pulley 48.

As previously noted, the preferred harness design for use by skaters directs the support forces to the upper portion of the legs of the user. This harness is shown in FIGS. 3 and 4.

Figure 3:
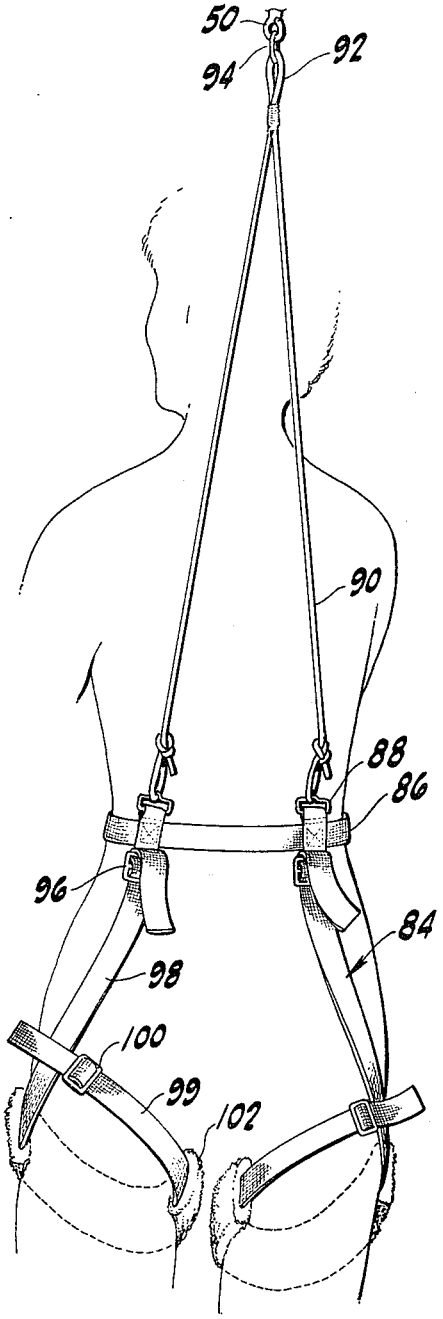
FIG. 3 is a schematic perspective view of the harness unit connected to the safety suspension unit of FIG. 1.
Figure 4:
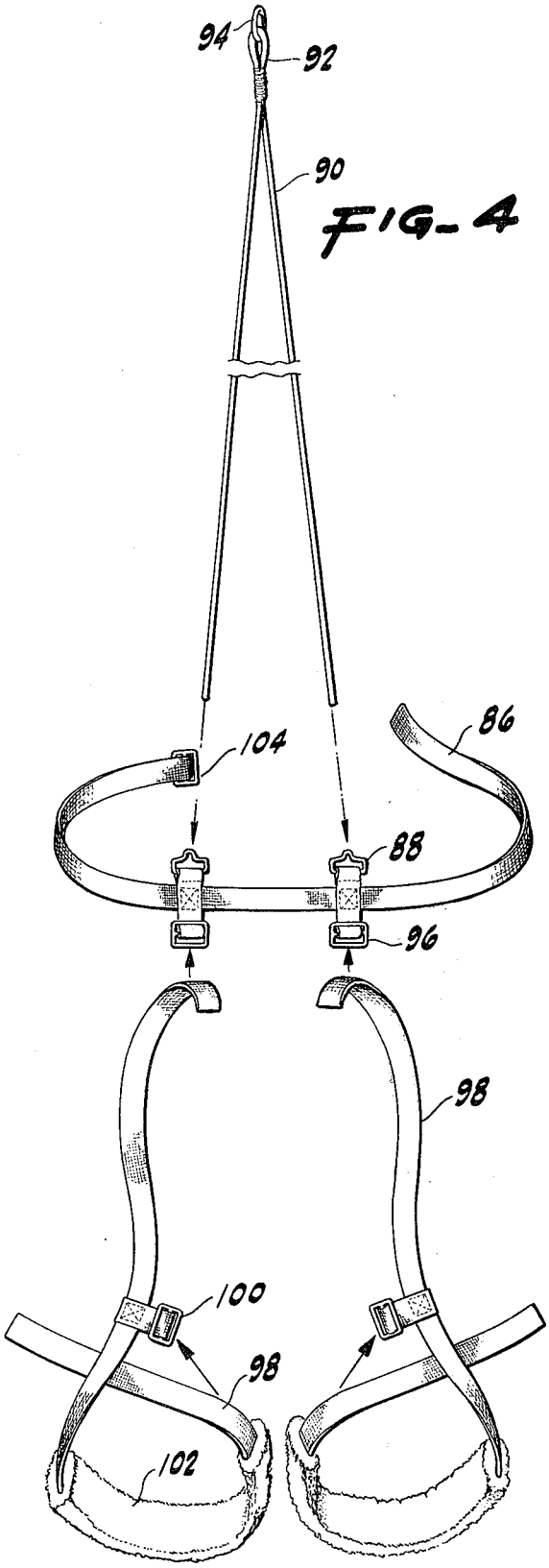
FIG. 4 is a layout of the harness unit of FIG. 1.

In FIG. 3, the harness 84 is shown from a view of the back of a user. The harness 84 includes a belt strap 86 which has two spaced rings 88 on the back of the belt for connecting the ends of a support cord 90. The support cord has an upper loop portion 92 which loops through a connection ring 94 which in turn is releasably connected to the swivel clip 50. Below the belt rings 88 are buckles 96 for connecting one of the ends of leg straps 98. The leg straps terminate in belt loops 99 with a buckle device 100 for looping around the upper thighs of the user and buckling at the user's lower hips. The belt loops provide a pivot point such that if the total weight of the user happened to be supported by the cable, the user would remain in an upright position, tilted slightly from the vertical.

For the user's comfort, a sheep skin cushion 102 is provided on the strap at each of the belt loops and each cushion 102 is slidably adjustable for maximum comfort. The harness and corresponding components are also shown in FIG. 4 laid out for system check out before use.

The use would first attach the belt strap 86 and tighten the belt strap buckle 104 such that the support rings are centered on the lower back of the user. Each lower belt loop is then adjusted around the upper portion of the user's legs with adjustment of the sheep skin cushions for comfort. The ends of the leg straps are then pulled to snug the harness. The cord is connected at the cord ring to the swivel clip either by pulling the cable down or by the user climbing a stool reaching and connecting the harness to the cable clip.

In using the safety suspension unit, it is contemplated that the tension spring be replaceable with other similar springs of different spring constant to provide a desired "lift" to users of various weights and abilities.

The harness unit while used to best advantage with the safety suspension unit, can also be used with a simple cable and ceiling mounted pulley system manipulated by an attendant. Such prior art cable systems can be enhanced by providing a tracking capability to the support pulley. This is accomplished in the subject safety suspension unit by incorporating an auxiliary pulley 108 mounted by a bracket 110 to the carriage 16. A cable (not shown) connected through the pulley 108 can be manipulated by an attendant with allowance for tracking of the carriage and connected pulley. This feature can be used to advantage in certain training maneuvers.

While in the foregoing specification embodiments of the invention have been set forth in considerable detail for the purposes of making a complete disclosure of the invention, it should be apparent to those of ordinary skill in the art that numerous changes may be made in such details without departing from the spirit and principles of the invention.

I claim:

1. A safety suspension unit for support of athletes during exercises comprising:

a fixed elevated track mountable to a support structure;

a carriage unit having tracking means engaging said elevated track for linear transport of said carriage on said elevated track;

wherein said carriage comprises an elongated structural member with first and second ends and wherein said tracking means comprise a pair of roller units connected to said ends of said structural member, said roller units having rollers in engagement with said track wherein said carriage is supported below said track;

a cable dispensing means with a support cable, said dispensing means connected to said carriage for dispensing said cable from said carriage in response to forces applied to said cable, said cable dispensing means having tension regulating means for increasing the tension of dispensed cable as said cable is dispensed; and connecting means for connecting said cable to the person of an athlete;

wherein said cable dispensing means comprises a pulley system with a first pulley connected to said first end of said structural member, and a second displaceable pulley connected to said tension regulating means, said tension regulating means being connected to said second end of said structural member, wherein said cable is connected to said second pulley and is threaded around said first pulley, around said second pulley and over said first pulley terminating at said connecting means.

2. The safety suspension unit of claim 1 wherein said connecting means includes a swivel clip enabling rotation of said connecting means.

3. The safety suspension unit of claim 1 wherein said tension regulating means comprises a tension spring.

4. The safety suspension unit of claim 1 wherein said tension regulating means comprises a tension spring having a first end connected to said second displaceable pulley and a second end connected to said second end of said structural member.

5. The safety suspension unit of claim 1 having cushioned stop means for limiting the dispension of cable from said cable dispensing means.

6. The safety suspension unit of claim 5 wherein said cushioned stop means comprises a compression spring mechanism having a displaceable connecting member with a first end connected to said second pulley and a second end engageable with said compression spring, said compression spring being mounted between said second end of said structural member and said second end of said displaceable connecting member wherein said compression spring is compressed on displacement of said second pulley displacing said connecting member.

7. The safety suspension unit of claim 1 wherein said connecting means includes a harness, said harness comprising: a belt strap adapted to encircle the waist of a user; a pair of depending strap members connected to said belt strap at a spacially displaced, centrally located, position on said belt strap at the back of the user wearing said belt strap, said depending strap members having fastening means, wherein each strap member is adapted to encircle an upper thigh of the user and fasten to said fastening means for transmitting support of the user to said depending strap members at the upper thighs; and support means connecting to said belt strap at said spacially displaced position on said belt for connecting said belt strap to said cable, for transmitting forces from said depending strap members directly to said cable.

* * * * *